US009677518B2

(12) United States Patent
Arima et al.

(10) Patent No.: US 9,677,518 B2
(45) Date of Patent: Jun. 13, 2017

(54) SADDLED VEHICLE

(71) Applicant: Kawasaki Jukogyo Kabushiki Kaisha, Hyogo (JP)

(72) Inventors: Hisatoyo Arima, Himeji (JP); Hiroyuki Watanabe, Kobe (JP); Takahiro Jyouzaki, Kakogawa (JP)

(73) Assignee: KAWASAKI JUKOGYO KABUSHIKI KAISHA (JP)

( * ) Notice: Subject to any disclaimer, the term of this patent is extended or adjusted under 35 U.S.C. 154(b) by 0 days.

(21) Appl. No.: 14/740,150

(22) Filed: Jun. 15, 2015

(65) Prior Publication Data

US 2015/0275833 A1 Oct. 1, 2015

Related U.S. Application Data

(63) Continuation of application No. PCT/JP2013/080512, filed on Nov. 12, 2013.

(30) Foreign Application Priority Data

Dec. 17, 2012 (JP) ..... 2012-274478

(51) Int. Cl.
*F01M 13/00* (2006.01)
*F01M 13/04* (2006.01)
(Continued)

(52) U.S. Cl.
CPC ..... *F02M 35/162* (2013.01); *F01M 13/00* (2013.01); *F01M 13/0033* (2013.01);
(Continued)

(58) Field of Classification Search
CPC ..... F02B 33/40; F02B 33/44; F02B 39/00; F02B 39/04; F01M 13/00; F01M 13/04;
(Continued)

(56) References Cited

U.S. PATENT DOCUMENTS 5,586,540 A 12/1996 Marzec et al.
6,273,074 B1 * 8/2001 Kawamata ..... F02M 25/06 123/572
(Continued)

FOREIGN PATENT DOCUMENTS

JP 55-001443 1/1980
JP 55-029077 3/1980
(Continued)

OTHER PUBLICATIONS

PCT/JP2013/080512 International Search Report dated Jan. 21, 2014, 2 pages.
(Continued)

*Primary Examiner* — Audrey K Bradley

(57) ABSTRACT

An engine (E) of a saddle-riding type vehicle has an engine case that is substantially L-shaped by a cylinder block (42) being protruded upward from an upper face of a front portion of a crank case (40). An air cleaner (55) is disposed rearwardly of the cylinder block (42) and above the crank case (40). An outlet (72) through which blow-by gas (G) in the engine (E) is discharged is formed in the rear portion of the cylinder block (42). A case body (84) of the air cleaner (55) has a blow-by gas introduction port (86) through which the blow-by gas (G) is introduced into the air cleaner (55). The outlet (72) of the cylinder block (42) and the blow-by gas introduction port (86) of the case body (84) are connected by a connecting pipe (90). The blow-by gas introduction port (86) is disposed close to the cylinder block (42).

15 Claims, 6 Drawing Sheets

(51) Int. Cl.

| | |
|---|---|
| ***F02M 35/04*** | (2006.01) |
| ***F02M 35/16*** | (2006.01) |
| ***F02B 39/00*** | (2006.01) |
| ***F02B 39/04*** | (2006.01) |
| ***F02F 7/00*** | (2006.01) |
| ***F02B 33/40*** | (2006.01) |
| ***F04D 17/10*** | (2006.01) |
| ***F02B 33/44*** | (2006.01) |
| *F02M 35/02* | (2006.01) |
| *F02M 35/10* | (2006.01) |
| *F01M 13/02* | (2006.01) |

(52) U.S. Cl.

CPC ..... *F01M 13/04* (2013.01); *F02B 33/40* (2013.01); *F02B 33/44* (2013.01); *F02B 39/00* (2013.01); *F02B 39/04* (2013.01); *F02F 7/00* (2013.01); *F04D 17/10* (2013.01); *F01M 2013/0038* (2013.01); *F01M 2013/027* (2013.01); *F01M 2013/0477* (2013.01); *F02M 35/0204* (2013.01); *F02M 35/04* (2013.01); *F02M 35/10157* (2013.01); *F02M 35/10209* (2013.01); *F02M 35/10255* (2013.01); *F02M 35/16* (2013.01)

(58) Field of Classification Search

CPC .... F01M 2013/0477; F01M 2013/0038; F02F 7/00; F02M 35/0204; F02M 35/04; F02M 35/10157; F02M 35/10209; F02M 35/10255; F02M 35/16; F02M 35/162; F04D 17/10

See application file for complete search history.

(56) References Cited

U.S. PATENT DOCUMENTS

2004/0159313 A1* 8/2004 Obayashi ..... F01M 13/04 123/572
2007/0289583 A1* 12/2007 Konakawa ..... F02M 35/10039 123/590
2008/0098701 A1* 5/2008 Takeshima ..... F02M 35/024 55/385.3
2008/0210206 A1* 9/2008 Kuji ..... F01M 13/04 123/573
2008/0223348 A1* 9/2008 Togasawa ..... B62K 11/04 123/572
2012/0240895 A1* 9/2012 Shimizu ..... B62K 11/10 123/198 E
2012/0260896 A1* 10/2012 Saeki ..... F02B 33/40 123/559.1
2013/0240281 A1* 9/2013 Inaoka ..... B62J 37/00 180/219

FOREIGN PATENT DOCUMENTS

| | | | | |
|---|---|---|---|---|
| JP | 57-137531 | | 8/1982 | |
| JP | 62-223420 | | 10/1987 | |
| JP | 63-121769 | | 8/1988 | |
| JP | 01-232112 | | 9/1989 | |
| JP | 01301918 | A * | 12/1989 | |
| JP | 02-024282 | | 1/1990 | |
| JP | 02-070920 | | 3/1990 | |
| JP | 09-099883 | | 4/1997 | |
| JP | 2007-113565 | | 5/2007 | |
| JP | 2008-031934 | | 2/2008 | |
| JP | 2008031934 | A * | 2/2008 | |
| JP | WO 2012070419 | A1 * | 5/2012 | ..... B62J 37/00 |

OTHER PUBLICATIONS

PCT Application No. PCT/JP2013/0080512 International Preliminary Report on Patentability dated Jun. 23, 2015, 8 pages.
Notification of Reason(s) for Rejection issued May 31, 2016 with English Language Summary of Notification of Reason(s) for Rejection for Japanese Patent Application No. 2014-553016; 5 pages.
Extended and Supplementary Search Report Issued Aug. 5, 2016 for Corresponding European Patent Application No. 13865360.5 (7 pages).
First Office Action Issued Oct. 9, 2016 for Corresponding Chinese Patent Application No. 201380065844.8 with English language Translation of Search Report attached to the Office Action (7 pages).

* cited by examiner

SADDLED VEHICLE

CROSS REFERENCE TO THE RELATED APPLICATION

This application is a continuation application, under 35 U.S.C. §111(a) of international application No. PCT/JP2013/080512, filed Nov. 12, 2013, which claims priority to Japanese patent application No. 2012-274478, filed Dec. 17, 2012, the entire disclosure of which is herein incorporated by reference as a part of this application.

BACKGROUND OF THE INVENTION

Field of the Invention

The present invention relates to saddle-riding type vehicles that include engines which serve as driving source, and air cleaners for purifying intake air.

Description of Related Art

Saddle-riding type vehicles equipped with engines has been known in which blow-by gas from the engines, which may cause air pollution, is recirculated into an air intake side such as an air cleaner, and then is mixed with new air-fuel mixture to be burned, in order not to discharge the blow-by gas to the atmosphere directly (for example, Patent Document 1).

RELATED DOCUMENT

Patent Document

[Patent Document 1] JP Laid-open Patent Publication No. 2007-113565

However, in the saddle-riding type vehicle as described in Patent Document 1, the air cleaner is generally disposed above the engine, and a pipe, for recirculation, connecting between the engine and the air cleaner may be elongated for introducing blow-by gas from the engine into the air cleaner.

SUMMARY OF THE INVENTION

In view of the above problem, an object of the present invention is to provide a saddle-riding type vehicle that allows a connecting pipe through which blow-by gas from an engine is introduced into an air cleaner to be shortened.

In order to attain the above object, a saddle-riding type vehicle of the present invention includes an engine that serves as a driving source and an air cleaner configured to purify intake air. The engine includes an engine case provided with an outlet which communicates with an outside of the engine and through which blow-by gas in the engine is discharged to the outside. The air cleaner includes a cleaner case provided with an introduction port through which the blow-by gas is introduced into the air cleaner. The engine case includes a crank case that supports an engine rotary shaft, a cylinder block that protrudes upward from an upper face of a front portion of the crank case, and a cylinder head disposed above the cylinder block, and the engine case is substantially L-shaped as viewed from a lateral side. The air cleaner is disposed in the rear of the cylinder block and above the crank case. The outlet and the introduction port are connected by a connecting pipe. The introduction port is disposed in an adjacent region, below an upper end of the cylinder head and in front of a rear end of the crank case.

In this configuration, since the outlet, for the blow-by gas, of the engine and the introduction port of the air cleaner are disposed so as to be close to each other, the connecting pipe can be shortened. As a result, the structure around the engine can be simplified, and the weight of the vehicle body can be reduced.

In the present invention, the cleaner case preferably includes a front wall forming a front face opposing a rear face of the cylinder block, and a lower wall forming a lower face opposing an upper face of the crank case. The introduction port is preferably formed in the front wall or the lower wall of the cleaner case. According to this configuration, an outlet for the blow-by gas is provided in the rear face of the cylinder block or the upper face of the crank case, whereby the outlet on the engine side and the introduction port on the air cleaner side can be disposed so as to be close to each other.

In the preferred embodiment of the present invention, the saddle-riding type vehicle further includes a supercharger configured to pressurize air purified by the air cleaner and supply the air to the engine. The supercharger is preferably disposed adjacent to the air cleaner in a vehicle widthwise direction. According to this configuration, the supercharger is provided, whereby the size of the air cleaner can be reduced. Further, the supercharger is disposed adjacent to the air cleaner, whereby the supercharger as well as the air cleaner can be disposed so as to be close to the engine.

When the supercharger is provided, the supercharger preferably includes an impeller configured to pressurize intake air, a housing that covers the impeller, and a transmission mechanism that transmits power from the engine to the impeller. The transmission mechanism and the cleaner case are preferably disposed so as to position the housing therebetween in the vehicle widthwise direction. According to this configuration, the cleaner case and the supercharger can be disposed in-line in the vehicle widthwise direction so as to prevent interference with the transmission mechanism.

In the present invention, the cleaner case preferably includes: an air intake passage through which the intake air is guided; and a gas-liquid separator chamber in which the blow-by gas guided through the introduction port is separated into gas and liquid. Gas separated in the gas-liquid separator chamber is preferably returned into the air intake passage, and liquid separated in the gas-liquid separator chamber is preferably drained through a drain hole to an outside of the cleaner case. According to this configuration, by the gas-liquid separator chamber being disposed, separation into gas and liquid is promoted. Moreover, since the gas-liquid separator chamber is provided separately from the air intake passage, flowing of the intake air is not prevented by the blow-by gas. Furthermore, since the air intake passage and the gas-liquid separator chamber are disposed in the air cleaner, gas separated in the gas-liquid separator chamber can be easily returned into the air intake passage.

When the gas-liquid separator chamber and the supercharger are provided, it is preferable that the saddle-riding type vehicle further includes: a supercharged air passage through which intake air pressurized by the supercharger is supplied to the engine; a relief valve configured to regulate air pressure in the supercharged air passage; and a relief passage that fluidly connects between the gas-liquid separator chamber and the relief valve. According to this configuration, the gas-liquid separator chamber can be used for both separating the blow-by gas into gas and liquid, and providing a space into which relieved air is returned.

In the present invention, an air intake duct through which incoming wind is guided as intake air to the air cleaner is preferably joined so as to extend from a portion in front of the engine through a side lateral to the engine. According to this configuration, as compared to a case where the air intake duct extends above the engine, a shorter air intake duct can be used to introduce intake air into the air cleaner.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

Hereinafter, a preferred embodiment of the present invention will be described with reference to the drawings. In the description herein, "left side" and "right side" represent the left side and the right side as viewed from a rider riding a vehicle.

Figure 1:
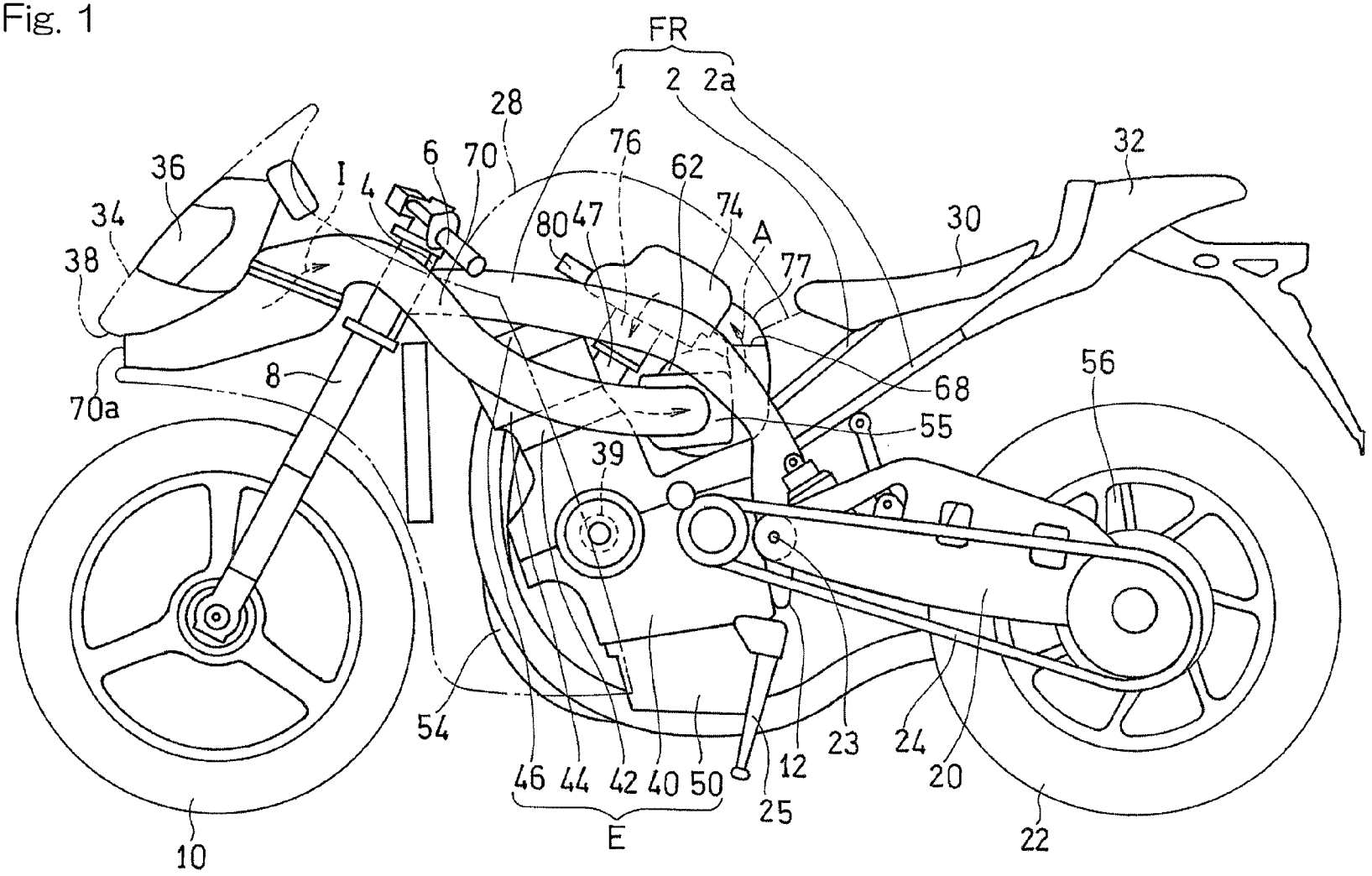
FIG. 1 is a side view of a motorcycle that is one kind of a saddle-riding type vehicle according to a first preferred embodiment of the present invention.

FIG. 1 is a left side view of a motorcycle that is one kind of a saddle-riding type vehicle according to a first preferred embodiment of the present invention. A motorcycle body frame structure FR of the motorcycle includes a main frame 1 that forms a front half of the motorcycle body frame structure, and a seat rail 2 and a reinforcing rail 2A that from a rear half of the motorcycle body frame structure. The seat rail 2 and the reinforcing rail 2A are attached to a rear portion of the main frame 1. A head pipe 4 is integrally formed in a front end of the main frame 1, and a front fork 8 is pivotally supported by the head pipe 4 through a steering shaft (not shown). A front wheel 10 is mounted to the front fork 8. A steering handle 6 is fixed to the upper end portion of the front fork 8.

On the other hand, a swing arm bracket 12 is mounted to a rear end portion, of the main frame 1, which is positioned at the center lower portion of the motorcycle body frame structure FR. A swing arm 20 is pivotably supported by the swing arm bracket 12 so as to be able to swing in the up-down direction. A rear wheel 22 is supported at the rear end portion of the swing arm 20 so as to be pivotable about a pivot 23. A combustion engine E that serves as a driving source is mounted forwardly or in front of the swing arm bracket 12 and below the center portion of the motorcycle body frame structure FR. The rear wheel 22 is driven through a power transmission mechanism 24 such as a chain by the combustion engine E. The combustion engine E is, for example, an overhead camshaft type parallel multi-cylinder water-cooled engine which is a four cylinder, four cycle engine. However, the type of the combustion engine E is not limited thereto. A side stand 25 is supported in the lower portion of the combustion engine E.

A fuel tank 28 is disposed above the main frame 1, and a rider's seat 30 and a fellow passenger's seat 32 are supported by the seat rail 2. Further, a fairing 34 made of resin is mounted in the front portion of the vehicle body, and covers a region from the front of the head pipe 4 to lateral sides of the front portion of the vehicle body. A head lamp unit 36 is mounted to the fairing 34. The fairing 34 is also provided with an air intake opening 38 through which intake air is introduced from the outside into the combustion engine E. The air intake opening 38 is positioned below the head lamp unit 36.

The combustion engine E includes a crankshaft 39 that extends in a vehicle widthwise direction, a crank case 40 that supports the crankshaft 39 and a transmission, a cylinder block 42 that protrudes upward from the upper face of the front portion of the crank case 40, a cylinder head 44 above the cylinder block, and an oil pan 50 disposed below the crank case 40. The crank case 40, the cylinder block 42, and the cylinder head 44 cooperate together to form an engine case. The cylinder block 42 and the cylinder head 44 are slightly tilted forward. Four exhaust pipes 54 are connected to an exhaust port in the front face of the cylinder head 44. The four exhaust pipes 54 are merged below the combustion engine E, and connected to an exhaust muffler 56 disposed to the right of the rear wheel 22.

An air cleaner 55 for purifying outside air and a supercharger 62 are disposed in-line in a left-right direction (the vehicle widthwise direction) on the upper face of the crank case 40 and rearwardly or in the rear of the cylinder block 42. The supercharger 62 pressurizes purified air from the air cleaner 55, and supplies the air to the combustion engine E.

Figure 2:
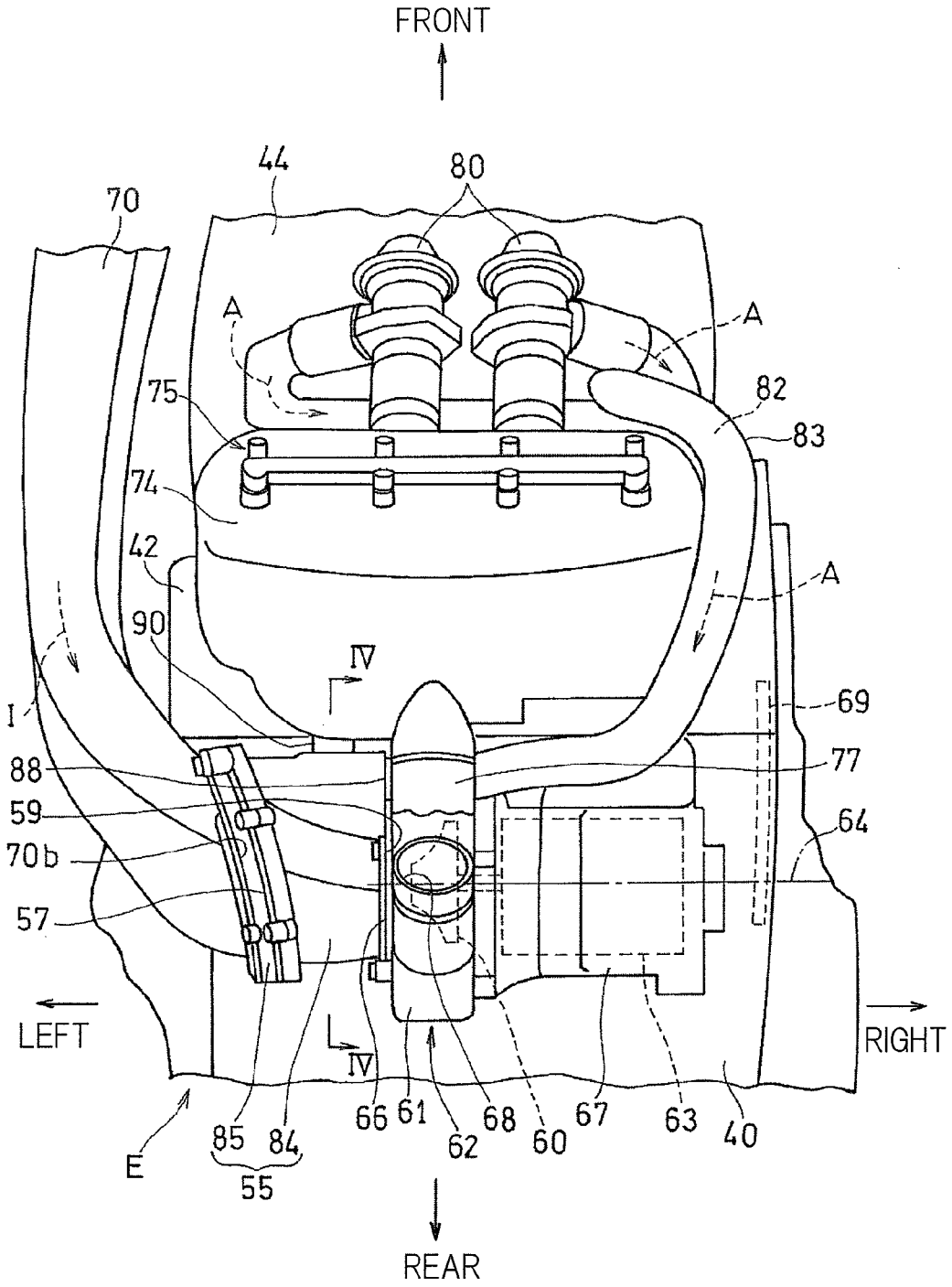
FIG. 2 is a perspective view of an engine of the motorcycle as viewed from diagonally above a rear side thereof.

As shown in the plan view of FIG. 2, the supercharger 62 is disposed adjacently to the right of air cleaner 55, and fixed to the upper face of the crank case 40 by means of bolts (not shown). The supercharger 62 has a rotation axis 64 that extends in the vehicle widthwise direction. A suction port 66 of the supercharger 62 is positioned above the crank case 40 and on the center portion, of the combustion engine E, in the widthwise direction. A discharge port 68 of the supercharger 62 is positioned on the center portion, of the combustion engine E, in the vehicle widthwise direction and in the rear of the rotation axis 64. The suction port 66 is opened leftward, and the discharge port 68 is opened upward.

The supercharger 62 includes an impeller 60 for pressurizing intake air; an impeller housing 61 that covers the impeller 60, a transmission mechanism 63 for transmitting power of the combustion engine E to the impeller 60, and a transmission mechanism housing 67 that covers the transmission mechanism 63. The transmission mechanism 63 and the air cleaner 55 are disposed so as to position the impeller housing 61 therebetween in the vehicle widthwise direction. The transmission mechanism 63 is disposed so as to be shifted to one side in the vehicle widthwise direction from the center in the vehicle widthwise direction. In the present preferred embodiment, the transmission mechanism 63 is shifted to the right side. A chain 69 that serves as a driving mechanism for the supercharger 62 is disposed on the right side.

Figure 3:
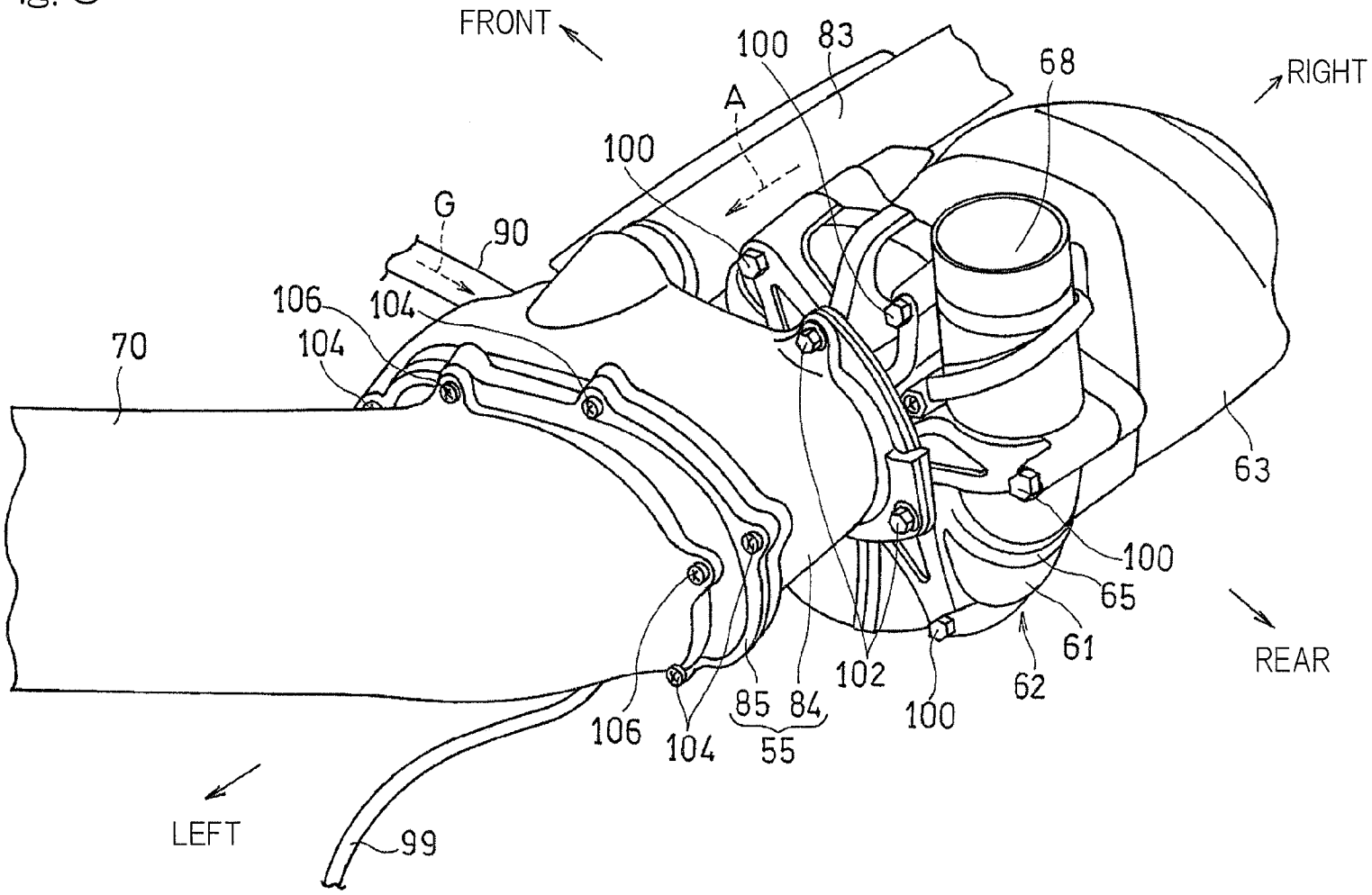
FIG. 3 is a perspective view of the engine as viewed from the diagonally rear left side thereof.

As shown in FIG. 3, a fixture 65 is mounted to the outer circumference of the impeller housing 61 of the supercharger 62. The impeller housing 61 is joined to the transmission mechanism housing 67 and the air cleaner 55 through the fixture 65. Specifically, the fixture 65 and the transmission mechanism housing 67 are joined to each other by means of a plurality of bolts 100, and the fixture 65 and the air cleaner 55 are joined to each other by means of a plurality of fastening members 102 such as bolts. In other words, the air cleaner 55 is fixed to the crank case 40 through the supercharger 62. By the air cleaner 55 being fixed to the crank case 40, the air cleaner 55 is easily positioned close to the crank case 40. In the present preferred embodiment, since the air cleaner 55 is fixed to the crank case 40 through the supercharger 62, a dedicated bracket need not be separately provided. The air cleaner 55 may be fixed directly to the engine case.

A cleaner outlet 59 of the air cleaner 55 is connected to the suction port 66 of the supercharger 62 as shown in FIG. 2. An air intake duct 70 is connected to a cleaner inlet 57 of the air cleaner 55 from the outer lateral side in the vehicle widthwise direction. The air intake duct 70 allows outside air to be introduced into the supercharger 62. The air intake duct 70 is disposed on the left side that is opposite to the right side on which the chain 69 is disposed. As shown in FIG. 1, the air intake duct 70 extends in a region lateral to the cylinder block 42 below the upper end of the cylinder head 44.

The air cleaner 55 is disposed in a space defined by the engine case that forms an L-shape, as viewed from the lateral side, with the crank case 40 and the cylinder block 42. Specifically, the air cleaner 55 is disposed in a space in the rear of the rear end of the cylinder head 44, in front of the rear end of the crank case 40, below the upper end of the cylinder head 44, and above the upper face of the crank case 40. Further, the air cleaner 55 shown in FIG. 2 is disposed in a region inward of both ends, of the crank case 40, in the vehicle widthwise direction.

As shown in FIG. 1, an intake air chamber 74 is disposed between the discharge port 68 of the supercharger 62 and an air intake port 47 of the combustion engine E in the front-rear direction. The intake air chamber 74 forms a portion of an intake air passage that extends from the discharge port 68 of the supercharger 62 toward the cylinder head 44. The discharge port 68 of the supercharger 62 and the intake air chamber 74 are connected by an intake pipe 77.

A throttle body 76 is disposed between the intake air chamber 74 and the cylinder head 44. In the throttle body 76, fuel is injected into intake air through a fuel injection valve 75 (FIG. 2), to generate air-fuel mixture, and the air-fuel mixture is supplied through each air intake port 47 to combustion chambers (not shown) in cylinder bores of the combustion engine E. The throttle body 76 is tilted upward towards the rear from the air intake port 47. The intake air chamber 74 is disposed above the supercharger 62 and the throttle body 76 and in the rear of the cylinder head 44.

The air cleaner 55 is disposed below the throttle body 76 and between the crank case 40 and the intake air chamber 74 as viewed from the lateral side. Thus, the air cleaner 55 is disposed below the throttle body 76 that is tilted diagonally upward in the rear direction, whereby space around the combustion engine E can be saved, and the air cleaner 55 is easily positioned above the crank case 40. The fuel tank 28 is disposed above the intake air chamber 74 and the throttle body 76.

The intake pipe 77, the intake air chamber 74 and the throttle body 76 cooperate together to form a supercharged air passage. The supercharged air passage is a passage through which intake air pressurized by the supercharger 62 is supplied to the combustion engine E. A relief valve 80 for regulating air pressure in the intake air chamber 74 is provided in front of the intake air chamber 74 shown in FIG. 2. A relief pipe 83 is connected to the relief valve 80. The relief pipe 83 forms a relief passage 82 through which high-pressure air A is delivered to the air cleaner 55. The relief pipe 83 extends, on the right lateral side of the intake air chamber 74, diagonally downward in the rear direction, and then extends leftward below the intake air chamber 74 between the cylinder block 42 or the cylinder head 44, and the supercharger 62, to be fluidly connected to the air cleaner 55.

The air intake duct 70 shown in FIG. 1 is disposed to the left of the combustion engine E, that is, on one of both lateral sides of the combustion engine E. The air intake duct 70 is supported by the head pipe 4 such that a front end opening 70*a* thereof faces the air intake opening 38 of the fairing 34. Pressure of air introduced through the front end opening 70*a* is increased due to ram effect. The cleaner inlet 57 of the air cleaner 55 is connected to a rear end portion 70*b* of the air intake duct 70 shown in FIG. 2. Thus, the air intake duct 70 extends from a portion in front of the combustion engine E through the outer left side lateral to the cylinder block 42 and the cylinder head 44, to introduce incoming wind as intake air into the air cleaner 55.

The air cleaner 55 includes a case body 84 having the cleaner outlet 59, and a cover 85 having the cleaner inlet 57. The case body 84 and the cover 85 are formed as aluminium castings, and are joined to each other by means of a plurality of screw members 104 as shown in FIG. 3. The rear end of the air intake duct 70 is supported by the cover 85 by means of a plurality of screw members 106. Thus, the case body 84 and the cover 85 also function as a support member for supporting the rear end of the air intake duct 70.

Figure 4:
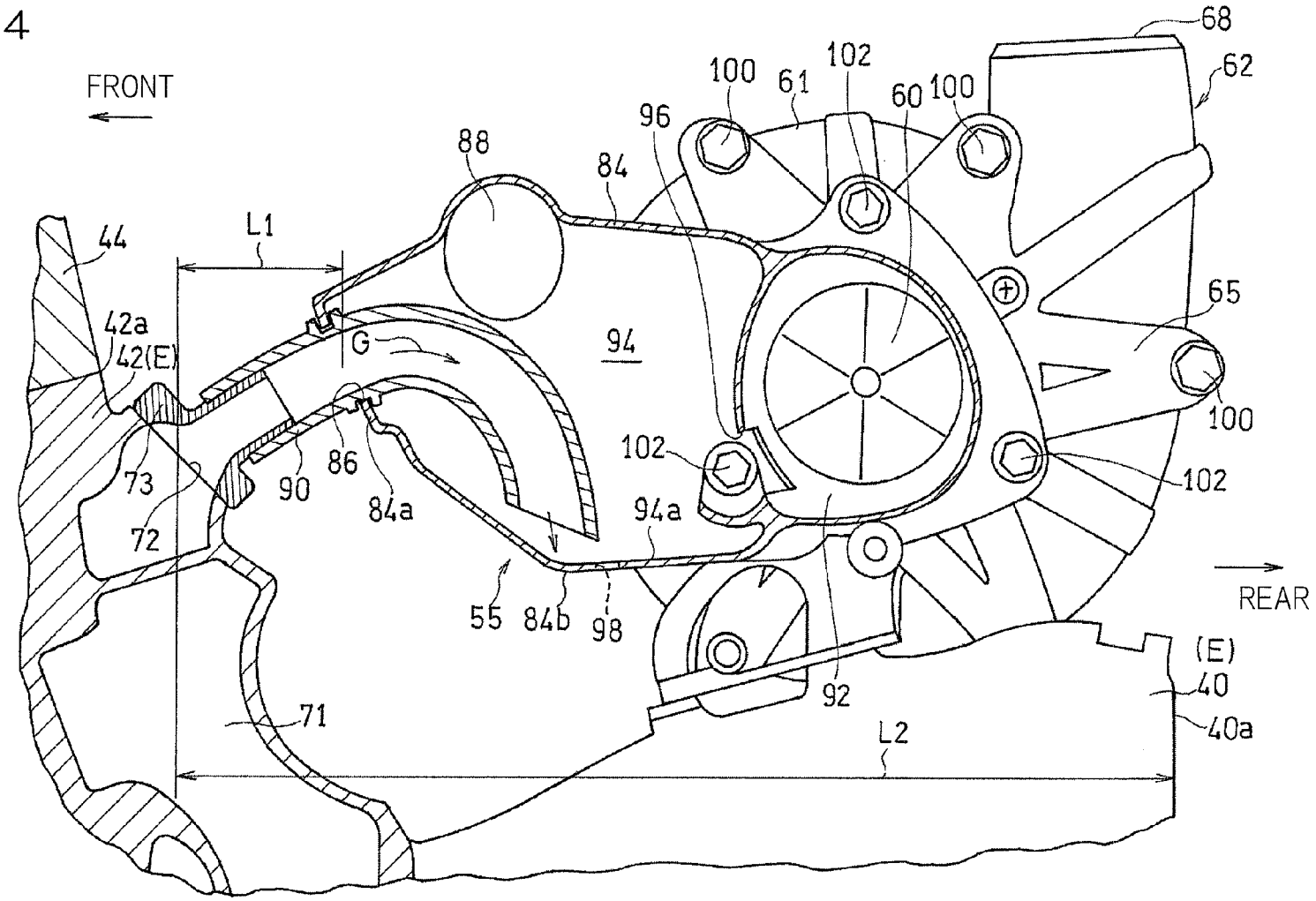
FIG. 4 is a longitudinal cross-sectional view as taken along a line IV-IV in FIG. 2.

As shown in FIG. 4, the case body 84 forming the cleaner case includes an air intake passage 92 for introducing intake air from the air intake duct 70 (FIG. 3), and a gas-liquid separator chamber 94, into which blow-by gas G from the combustion engine E is introduced. In the gas-liquid separator chamber 94, the blow-by gas is separated into gas and liquid. The air intake passage 92 fluidly connects between the cleaner inlet 57 and the cleaner outlet 59 shown in FIG. 2. In the air cleaner 55, the gas-liquid separator chamber 94 and the air intake passage 92 are disposed in-line in the front-rear direction or longitudinal direction, and communicate with each other through a communication hole 96. The communication hole 96 is positioned above a bottom face 94*a* forming the lowest portion of the gas-liquid separator chamber 94. Thus, liquid separated in the gas-liquid separator chamber 94 can be prevented from flowing toward the air intake passage 92.

In the gas-liquid separator chamber 94 of the case body 84, are formed a blow-by gas introduction port 86 through which the blow-by gas G in the combustion engine is introduced into the air cleaner 55, and a high-pressure air introduction port 88. The relief pipe 83 from the relief valve 80 fitted to the intake air chamber 74 shown in FIG. 2 is connected to the high-pressure air introduction port 88, to introduce the high-pressure air A into the air cleaner 55. The high-pressure air introduction port 88 shown in FIG. 4 is positioned above the blow-by gas introduction port 86. The blow-by gas introduction port 86 is opened forward, and the high-pressure air introduction port 88 is opened rightward.

A breather chamber 71 and an outlet 72 are formed in the rear portion of the cylinder block 42 of the combustion engine E, by molding for the cylinder block 42. The blow-by gas G leaks from between a piston (not shown) and the cylinder bore (not shown), and the blow-by gas G is separated into liquid (oil) and gas in the breather chamber 71. The outlet 72 communicates with the outside of the engine, to discharge the blow-by gas G contained in the combustion engine.

A discharge nozzle 73 is joined to the outlet 72 by means of screws, and the discharge nozzle 73 and the blow-by gas introduction port 86 of the air cleaner 55 are connected to each other by means of a connecting pipe 90. The connecting pipe 90 is curved downward in the gas-liquid separator chamber 94, and is disposed with a tip end thereof opposing and close to the bottom face 94*a* of the gas-liquid separator chamber 94. Thus, the blow-by gas G introduced from the blow-by gas introduction port 86 is caused to collide with the bottom face 94*a* of the gas-liquid separator chamber 94, to promote separation into gas and liquid.

The blow-by gas introduction port 86 of the air cleaner 55 is positioned below an upper end 42*a* (the lower end of the cylinder head 44) of the cylinder block 42 and in front of a rear end 40*a* of the crank case 40 so as to be close to the outlet 72. A distance L1 between the blow-by gas introduction port 86 and the outlet 72 is preferably less than or equal to ½ of a distance L2, in the horizontal direction, between the outlet 72 and the rear end 40*a* of the crank case 40, and is more preferably less than or equal to ⅓ or ¼ of the distance L2. However, the outlet 72 of the combustion engine E may be formed in the upper portion of the crank case 40, and the blow-by gas introduction port 86 may be formed in a lower wall 84*b* of the case body 84. In this case, a distance between the blow-by gas introduction port 86 and the outlet 72 is less than a dimension of the air cleaner 55 in the up-down direction, and is preferably less than or equal to ½ or ⅓ of the dimension in the up-down direction.

The blow-by gas introduction port 86 is disposed so as to be close to the cylinder block 42 that is a portion of the engine case. Specifically, the case body 84 has a front wall 84*a* forming the front face and the lower wall 84*b* forming the lower face. The front wall 84*a* opposes the rear face of the cylinder block 42, and the lower wall 84*b* opposes the upper face of the crank case 40. The blow-by gas introduction port 86 is formed in the front wall 84*a* of the case body 84. A drain hole 98 is formed in the lower wall 84*b* of the case body 84, and oil separated in the gas-liquid separator chamber 94 is drained through the drain hole 98. One end portion of a drain pipe 99 shown in FIG. 3 is connected to the drain hole 98, and the other end portion of the drain pipe 99 is connected to an oil tank (not shown).

Figure 5:
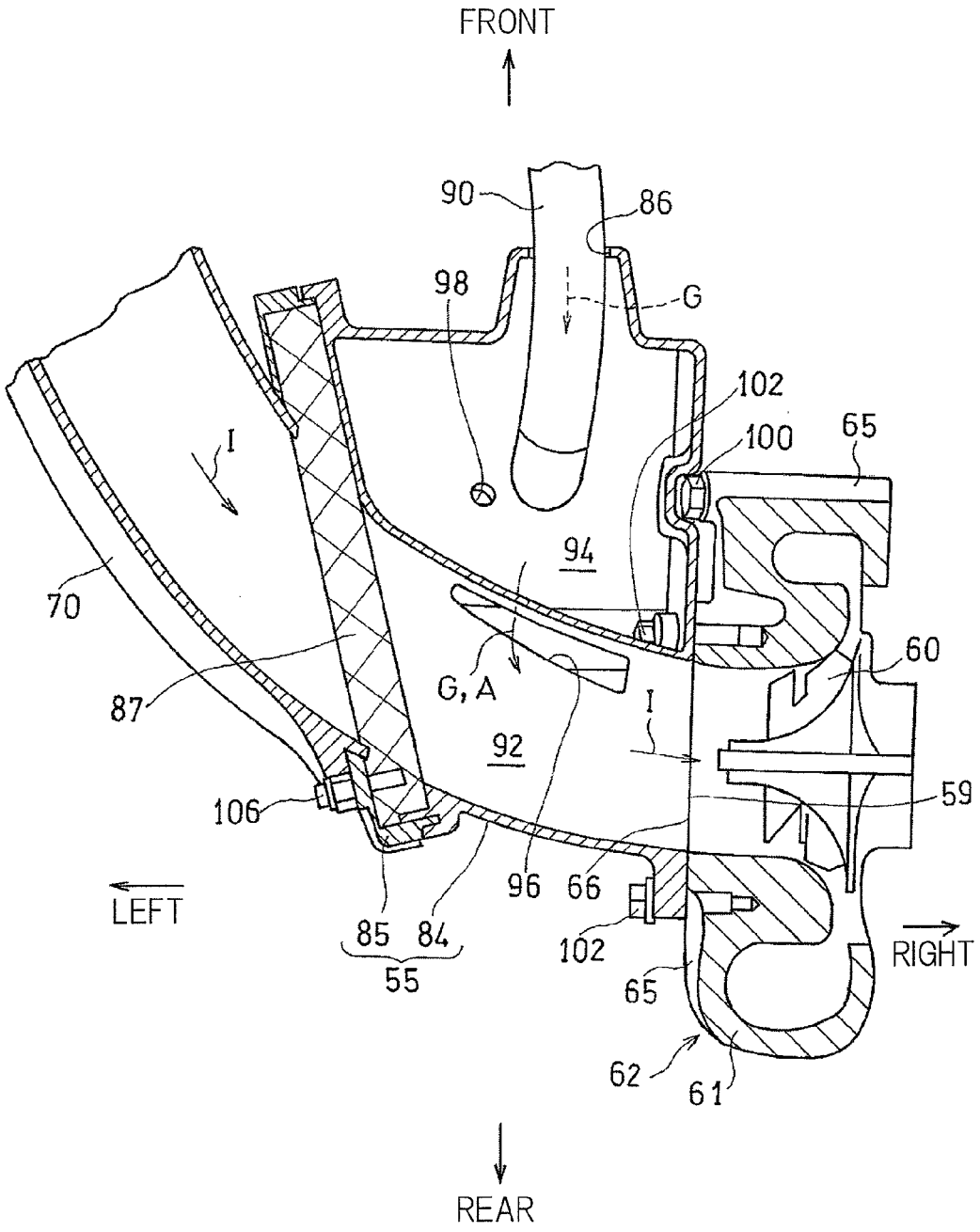
FIG. 5 is a horizontal cross-sectional view of an air cleaner of the motorcycle.
Figure 6:
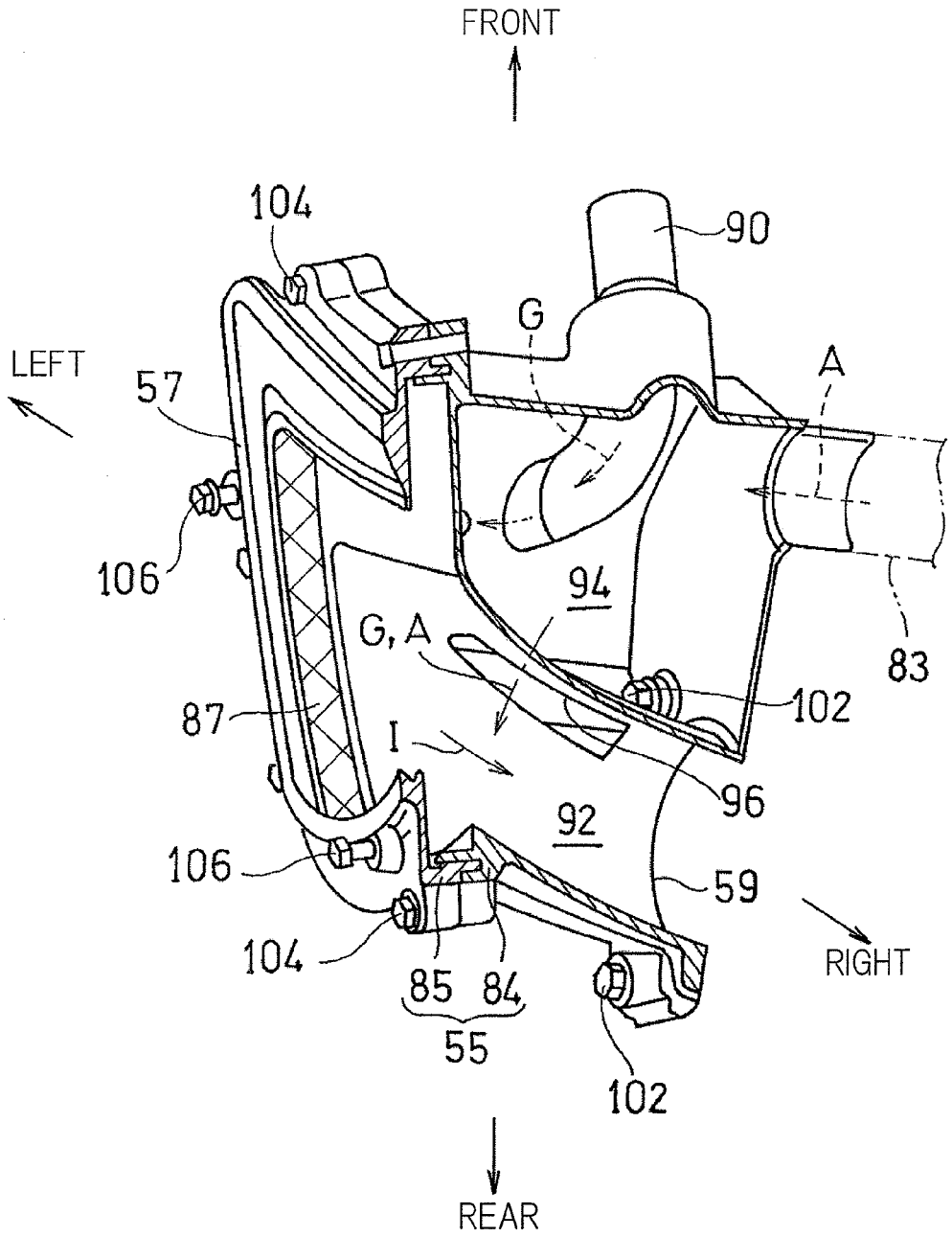
FIG. 6 is another horizontal cross-sectional view of the air cleaner thereof.

FIG. 5 is a horizontal cross-sectional view including the center portion of the blow-by gas introduction port 86 of the air cleaner 55. FIG. 6 is a horizontal cross-sectional view including the center portion of the high-pressure air introduction port 88. As shown in FIG. 5, a cleaner element 87 for purifying outside air (intake air) I is disposed between the case body 84 and the cover 85. In such a structure, the cleaner element 87 can be disposed in the air cleaner 55 without using a frame for supporting the cleaner element 87. The cleaner element 87 extends along a plane that intersects a plane extending in the left-right direction.

The case body 84 is filled with the intake air I that has been purified by the cleaner element 87 and has not been pressurized by the impeller 60 of the supercharger 62. The intake air I that has not been pressurized may be stored in an amount less than that of the intake air I having been pressurized. Accordingly, the case body 84 in which the intake air I that has not been pressurized is stored may be smaller than the intake air chamber 74 in which the intake air I having been pressurized is stored, as shown in FIG. 2, and the air cleaner 55 having a reduced size can be disposed so as to be close to the engine case. As shown in FIG. 1, the rear end of the air cleaner 55 is positioned in front of the rear end of the crank case 40, and the upper end of the air cleaner 55 is positioned below the upper end of the cylinder head 44.

In the air intake passage 92 in the case body 84 shown in FIG. 5, a direction in which the intake air I flows at the inlet 57 is different from a direction in which the intake air I flows at the outlet 59, and an axis line of the air intake passage 92 fluidly connecting between the inlet 57 and the outlet 59 is smoothly curved. Specifically, the air intake passage 92 is smoothly curved such that the intake air I guided rearward along the left side of the vehicle body through the air intake duct 70 is guided to the suction port 66, of the supercharger 62, which is opened leftward.

The gas-liquid separator chamber 94 is formed forwardly of the air intake passage 92 so as to be closer to the blow-by gas introduction port 86 than the air intake passage 92. Thus, increasing of a curvature of the air intake passage 92 is prevented, and a space formed by the air intake passage 92 being curved can be effectively used to form the gas-liquid separator chamber 94. Further, the air intake passage 92 has a passage area that is gradually reduced from the upstream side toward the downstream side, and the passage area thereof is minimal at the outlet 59. Due to both variation of the passage area and the shape in which the above-described axis line is varied so as to be smoothly curved, the gas-liquid separator chamber 94 is easily positioned in front of the air intake passage 92.

As shown in FIG. 6, the communication hole 96, through which the air intake passage 92 and the gas-liquid separator chamber 94 communicate with each other, is formed into a slit-shape that is elongated in the left-right direction. Before the air intake duct 70 is connected to the air cleaner 55, one of the fastening members 102 for fixing the case body 84 to the supercharger 62 (FIG. 5) can be operated through the communication hole 96 from the left side of the case body 84.

An operation of the air cleaner 55 will be described. When the motorcycle travels, incoming wind is taken as the intake air I through the air intake opening 38 into the air intake duct 70 shown in FIG. 1. The intake air I flows rearward in the air intake duct 70, and is guided to the air cleaner 55 while its flowing direction is varied such that the intake air I flows inward in the vehicle widthwise direction.

The intake air I guided into the air cleaner 55 is purified by the cleaner element 87 shown in FIG. 5, and then passes through the air intake passage 92 in the air cleaner 55, so as to be introduced into the supercharger 62. The intake air I introduced into the supercharger 62 is pressurized by the impeller 60, and is then discharged through the discharge port 68 of the supercharger 62 shown in FIG. 1. The high-pressure air A discharged from the supercharger 62 is guided through the intake pipe 77 to the intake air chamber 74, and is then supplied through the throttle body 76 to the air intake port 47 of the combustion engine E.

When a pressure in the supercharged air passage downstream side of the supercharger 62 indicates a value higher than a predetermined value, the relief valve 80 (shown in FIG. 2) provided in the intake air chamber 74 is opened, to regulate pressure in the supercharged air passage which includes the intake air chamber 74. The high-pressure air A relieved from the relief valve 80 is introduced through the relief passage 82 shown in FIG. 2 into the gas-liquid separator chamber 94 of the air cleaner 55 shown in FIG. 6.

The high-pressure air A introduced into the gas-liquid separator chamber 94 is returned through the communication hole 96 into the air intake passage 92.

On the other hand, while the motorcycle is traveling, the blow-by gas G in the combustion engine is separated into gas and liquid while passing through the breather chamber 71 in the rear portion of the cylinder block 42 shown in FIG. 4. The blow-by gas G of air separated in the breather chamber 71 flows from the outlet 72, and passes through the discharge nozzle 73 and the connecting pipe 90, so as to be introduced from the blow-by gas introduction port 86 into the gas-liquid separator chamber 94 of the air cleaner 55.

The blow-by gas G introduced into the gas-liquid separator chamber 94 collides with the bottom face 94*a* of the gas-liquid separator chamber 94 when flowing from the connecting pipe 90, and is further separated into gas and liquid. Gas separated in the gas-liquid separator chamber 94 is returned through the communication hole 96 shown in FIG. 5 into the air intake passage 92 together with the high-pressure air A. The blow-by gas G is introduced, through the connecting pipe 90, in a direction different from a direction in which the high-pressure air A is introduced through the high-pressure air introduction port 88 so as to prevent the blow-by gas G from being agitated by the high-pressure air A as shown in FIG. 6. Specifically, the blow-by gas G shown in FIG. 4 is introduced downward, and the high-pressure air A is introduced in substantially the horizontal direction from a portion upward of the lower end portion, of the connecting pipe 90, which is an outlet for the blow-by gas G.

Oil separated in the gas-liquid separator chamber 94 is drained through the drain hole 98 to the outside of the air cleaner 55, and is returned to an oil tank through the drain pipe 99 shown in FIG. 3. Since the air cleaner 55 is disposed on the left side on which the side stand 25 (FIG. 1) is provided, the vehicle body is tilted leftward when parked, whereby the separated liquid can be easily guided to the drain pipe 99 disposed on the left side.

In the above configuration, as shown in FIG. 4, since the outlet 72 for the blow-by gas G in the combustion engine E and the blow-by gas introduction port 86 of the air cleaner 55 are disposed so as to be close to each other, the connecting pipe 90 can be shortened. As a result, the structure around the combustion engine E can be simplified, and the weight of the vehicle body can be reduced. Further, by the outlet 72 for the blow-by gas G being disposed in the rear portion of the cylinder block 42, the outlet 72 of the combustion engine E and the blow-by gas introduction port 86 of the air cleaner 55 can be disposed so as to be close to each other.

Further, since the gas-liquid separator chamber 94 is disposed in the air cleaner 55, separation of the blow-by gas G into gas and liquid is promoted. Furthermore, since the air intake passage 92 and the gas-liquid separator chamber 94 are disposed in neighboring in the air cleaner 55, gas of the blow-by gas G separated in the gas-liquid separator chamber 94 can be easily returned into the air intake passage 92. Moreover, since the gas-liquid separator chamber 94 is provided separately from the air intake passage 92, flowing of the intake air I is not prevented by the blow-by gas G.

As shown in FIG. 2, the supercharger 62 is provided adjacent to the air cleaner 55 in the vehicle widthwise direction, whereby the supercharger 62 as well as the air cleaner 55 can be disposed so as to be close to the combustion engine E. Moreover, the supercharger 62 is provided, whereby the capacity of the air cleaner 55 can be reduced, and space around the engine can be saved.

As shown in FIG. 6, since the relief pipe 83 is connected to the gas-liquid separator chamber 94, the gas-liquid separator chamber 94 can be used concurrently for both separation of the blow-by gas G into gas and liquid and returning of the relieved high-pressure air A.

Since the transmission mechanism 63 of the supercharger 62 and the air cleaner 55 as shown in FIG. 2 are disposed so as to position the impeller housing 61 therebetween in the vehicle widthwise direction, the air cleaner 55 and the supercharger 62 can be disposed in-line in the vehicle widthwise direction so as to prevent interference with the transmission mechanism 63.

The air intake duct 70 through which incoming wind is guided as the intake air I is joined to the air cleaner 55 shown in FIG. 1, and further the intake air I is pressurized by the supercharger 62. Therefore, synergy of ram pressure and pressurization by the supercharger 62 allows the high-pressure intake air I to be supplied to the combustion engine E, so as to improve air intake efficiency.

The breather chamber 71 disposed in the rear portion of the cylinder block 42 and the front wall 84*a* of the air cleaner 55 as shown in FIG. 4 are connected through the connecting pipe 90. Therefore, the connecting pipe 90 can be shortened, and a structure around the engine can be further simplified.

The present invention is not limited to the embodiment described above, and various additions, modifications, or deletions may be made without departing from the gist of the invention. For example, although, in the above preferred embodiment, the outlet 72 from the engine case is formed in the rear portion of the cylinder block 42, the present invention is not limited thereto. The outlet 72 may be formed in the upper portion of the crank case 40, or formed in the cylinder head 44. Even in such cases, the introduction port 86 is disposed opposing and close to the outlet 72, whereby the connecting pipe 90 can be shortened.

Further, although, in the above preferred embodiment, incoming wind is used as the intake air I, incoming wind may not be used as intake air. Further, although the saddle-riding type vehicle of the present invention preferably has a supercharger, no supercharger may be mounted thereto. Moreover, the saddle-riding type vehicle of the present invention may be a vehicle other than a motorcycle, specifically, may be a four-wheeled buggy, a three-wheeled vehicle, or the like. Therefore, these are construed as included within the scope of the present invention.

REFERENCE NUMERALS

39 . . . crankshaft (engine rotary shaft)
40 . . . crank case (engine case)
42 . . . cylinder block (engine case)
44 . . . cylinder head (engine case)
55 . . . air cleaner
60 . . . impeller
61 . . . housing
62 . . . supercharger
63 . . . transmission mechanism
70 . . . air intake duct (duct)
71 . . . breather chamber
72 . . . outlet
74 . . . intake air chamber (supercharged air passage)
80 . . . relief valve
82 . . . relief passage
84 . . . case body (cleaner case)
84*a* . . . front wall of case body
84*b* . . . lower wall of case body
86 . . . blow-by gas introduction port (introduction port)

90 . . . connecting pipe
92 . . . air intake passage
94 . . . gas-liquid separator chamber
98 . . . drain hole
E . . . engine
G . . . blow-by gas

What is claimed is:

1. A saddle-riding vehicle comprising:
an engine that serves as a driving source; and
an air cleaner configured to purify intake air, wherein
the engine includes an engine case provided with an outlet which communicates with an outside of the engine and through which blow-by gas in the engine is discharged to the outside,
the air cleaner includes a cleaner case provided with an introduction port through which the blow-by gas is introduced into the air cleaner by the outlet located upstream from the introduction port,
the engine case includes a crank case that supports an engine rotary shaft, a cylinder block that protrudes upward from an upper face of a front portion of the crank case, and a cylinder head disposed above the cylinder block,
the air cleaner is disposed in the rear of the cylinder block and above the crank case,
the outlet and the introduction port are connected by a connecting pipe,
the outlet is formed in one of a rear portion of the cylinder block or in an upper portion of the crank case,
the introduction port is disposed in a region, below an upper end of the cylinder head and a throttle body and in front of a rear end of the crank case, and
the introduction port is formed in a wall of the cleaner case, which wall opposes the outlet.

2. The saddle-riding vehicle as claimed in claim 1, wherein the cleaner case includes:
a front wall forming a front face adjacent a rear face of the cylinder block; and
a lower wall forming a lower face that directly opposes an upper face of a rear portion of the crank case rearward of the cylinder block, and
the introduction port is formed in the front wall or the lower wall of the cleaner case.

3. The saddle-riding vehicle as claimed in claim 1, further comprising a duct configured to guide incoming wind as intake air to the air cleaner and extending from a portion in front of the engine through a side lateral to the engine.

4. The saddle-riding vehicle as claimed in claim 1, further comprising the throttle body is tilted diagonally upward in the rear direction.

5. The saddle-riding vehicle as claimed in claim 1, further comprising the connecting pipe is curved within the cleaner case, and is disposed with a tip end thereof opposing to a wall face of the cleaner case to separate the blow by gas into a gas and liquid.

6. The saddle-riding vehicle as claimed in claim 1, further including an air intake duct through which incoming wind is guided as intake air to the air cleaner from the front of the vehicle along a side of the cylinder block to the air cleaner.

7. The saddle-riding vehicle as claimed in claim 1, wherein the outlet is formed in the rear portion of the cylinder block.

8. The saddle-riding vehicle as claimed in claim 7, wherein
the air cleaner case includes an air intake passage through which the intake air is guided,
a gas-liquid separator chamber in which the blow-by gas guided through the introduction port is separated into gas and liquid, and
the air intake passage and the gas-liquid separator chamber are disposed in the air cleaner in-line in a longitudinal direction of the vehicle, with the gas-liquid separator chamber being formed forwardly of the air intake passage.

9. The saddle-riding vehicle as claimed in claim 7, further comprising a breather chamber formed in the rear portion of the cylinder block, in which the blow-by gas is separated into liquid and gas.

10. A saddle-riding vehicle comprising:
an engine that serves as a driving source; and
an air cleaner configured to purify intake air, wherein
the engine includes an engine case provided with an outlet which communicates with an outside of the engine and through which blow-by gas in the engine is discharged to the outside,
the air cleaner includes a cleaner case provided with an introduction port through which the blow-by gas is introduced into the air cleaner,
the engine case includes a crank case that supports an engine rotary shaft, a cylinder block that protrudes upward from an upper face of a front portion of the crank case, and a cylinder head disposed above the cylinder block,
the air cleaner is disposed in the rear of the cylinder block and above the crank case,
the outlet and the introduction port are connected by a connecting pipe, and
the introduction port is disposed in a region, below an upper end of the cylinder head and in front of a rear end of the crank case,
further comprising a supercharger configured to pressurize air purified by the air cleaner, and supply the air to the engine, wherein
the supercharger is disposed adjacent to the air cleaner in a vehicle widthwise direction.

11. The saddle-riding vehicle as claimed in claim 10, wherein the supercharger includes:
an impeller configured to pressurize intake air;
a housing that covers the impeller; and
a transmission mechanism that transmits power from the engine to the impeller, and
the transmission mechanism and the cleaner case are disposed so as to position the housing therebetween in the vehicle widthwise direction.

12. The saddle-riding vehicle as claimed in claim 10, wherein
the cleaner case includes an air intake passage through which the intake air is guided,
a gas-liquid separator chamber in which the blow-by gas guided through the introduction port is separated into gas and liquid, and
gas separated in the gas-liquid separator chamber is returned into the air intake passage, and liquid separated in the gas-liquid separator chamber is drained through a drain hole to an outside of the cleaner case.

13. The saddle-riding vehicle as claimed in claim 12, further comprising:
a supercharged air passage through which intake air pressurized by the supercharger is supplied to the engine;
a relief valve configured to regulate air pressure in the supercharged air passage; and a relief passage that fluidly connects between the gas-liquid separator chamber and the relief valve.

14. A saddle-riding vehicle comprising:

an engine that serves as a driving source; and an air cleaner configured to purify intake air, wherein the engine includes an engine case provided with an outlet which communicates with an outside of the engine and through which blow-by gas in the engine is discharged to the outside, the air cleaner includes a cleaner case provided with an introduction port through which the blow-by gas is introduced into the air cleaner, the engine case includes a crank case that supports an engine notary shaft, a cylinder block that protrudes upward from an upper face of a front portion of the crank case and a cylinder head disposed above the cylinder block, the air cleaner is disposed in the rear of the cylinder block and above the crank case, the outlet and the introduction port are connected by a connecting pipe, the outlet is formed in one of a rear portion of the cylinder block or in an upper portion of the crank case, the introduction port is disposed in a region, below an upper end of the cylinder head and a throttle body and in front of a rear end of the crank case, the air cleaner is above the crank case and a supercharger is connected to the air cleaner in the vehicle widthwise direction, the supercharger includes an impeller within an impeller housing for pressurizing intake air from the air cleaner and a transmission mechanism within a transmission housing for providing power from the engine to the impeller, the transmission mechanism and the air cleaner are positioned above the crank case with the supercharger between the air cleaner and the transmission mechanism in the vehicle widthwise direction, and a fixture mounted on the impeller housing joins the transmission housing, the air cleaner and the supercharger in the vehicle widthwise direction for fixing to the engine case.

15. The saddle-riding vehicle as claimed in claim 14, including a rider seat on an upper surface of the vehicle and located at a position lengthwise of the vehicle to the rear of the air cleaner and the crank case.

* * * * *